US006435227B1

(12) United States Patent
Heinle

(10) Patent No.: US 6,435,227 B1
(45) Date of Patent: Aug. 20, 2002

(54) TANK FILLING APPARATUS AND METHOD

(75) Inventor: Michael W. Heinle, Baton Rouge, LA (US)

(73) Assignee: California International Chemical Corporation, Tokyo (JP)

( * ) Notice: Subject to any disclaimer, the term of this patent is extended or adjusted under 35 U.S.C. 154(b) by 0 days.

(21) Appl. No.: 09/819,035

(22) Filed: Apr. 19, 2001

Related U.S. Application Data

(63) Continuation of application No. 09/280,776, filed on Mar. 29, 1999, now abandoned.

(51) Int. Cl.[7] ..... B65B 31/00

(52) U.S. Cl. ..... 141/63; 141/2; 141/4; 141/18; 141/44; 141/89

(58) Field of Search ..... 141/2–4, 18, 21, 141/37, 44, 49, 63, 89, 91

(56) References Cited

U.S. PATENT DOCUMENTS

| | | | | |
|---|---|---|---|---|
| 2,469,434 A | | 3/1949 | Hansen et al. | |
| 2,645,907 A | | 7/1953 | Droste et al. | |
| 4,098,303 A | | 7/1978 | Gammell | 141/52 |
| 4,769,137 A | | 9/1988 | Powell, Jr. et al. | 210/139 |
| 5,042,840 A | | 8/1991 | Rieple et al. | 280/830 |
| 5,214,952 A | * | 6/1993 | Leggett et al. | 73/1.03 |
| 5,379,793 A | | 1/1995 | Powell | 137/15 |
| 5,495,875 A | | 3/1996 | Benning et al. | 141/83 |
| 5,937,918 A | | 8/1999 | Takeharada et al. | |

* cited by examiner

*Primary Examiner*—J. Casimet Jacyna
(74) *Attorney, Agent, or Firm*—Sughrue Mion, PLLC

(57) ABSTRACT

An apparatus and method for transferring liquid chlorine or other process material from a larger container to one or more smaller containers, including a valve assembly used to minimize chemical loss, is disclosed herein. The valve assembly minimizes chlorine or other process material loss to the environment by sealing the manifold and the filled cylinder from the environment while the valve assembly is disconnected. The apparatus and methods disclosed herein minimize caustic use associated with purging of the apparatus.

31 Claims, 3 Drawing Sheets

FIGURE 2c
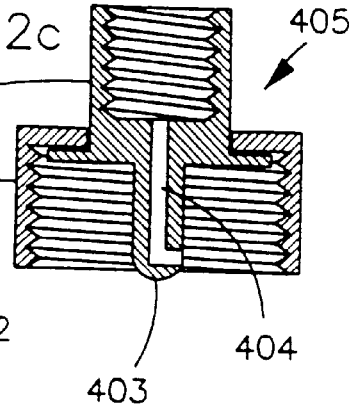
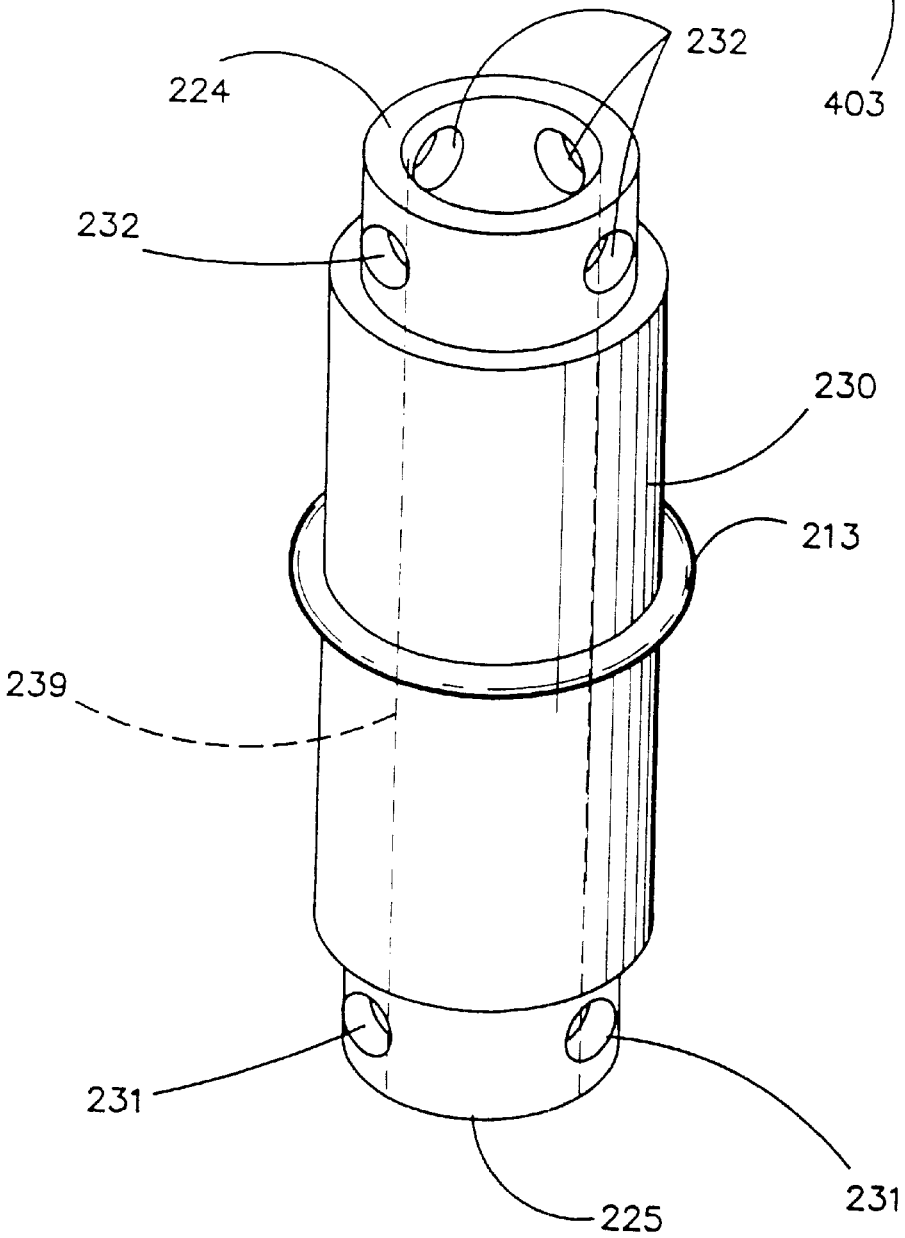
FIGURE 2b

TANK FILLING APPARATUS AND METHOD

This is a continuation of application Ser. No. 09/280,776 filed Mar. 29, 1999 and now abandoned, the disclosure of which is incorporated herein by reference.

BACKGROUND OF THE INVENTION

1. Field of the Invention

This invention relates to a method and apparatus for filling liquid and gas cylinders, more particularly an apparatus that reduces the amount of process material gas wasted during the filling and disposal processes.

2. Prior Art

Presently, there are a variety of methods and apparatuses used for filling liquid and gas cylinders, including chlorine cylinders. Current methods and apparatuses used for filling chlorine cylinders use vacuum systems within the filling manifold to purge the manifold of chlorine for safe and effective operation. Vacuum systems, however, are expensive both from an equipment and a maintenance standpoint because special equipment is required to construct and maintain a vacuum system.

Presently, many chlorine cylinder handling systems comprise a source tank, a filling manifold, a purge gas source, a vacuum system to purge the manifold, and a neutralization tank. After each chlorine cylinder is filled, the filling manifold must be purged of chlorine. The purged chlorine flows into a holding tank where the purged chlorine is neutralized using caustic material. Units which process about 1000 pounds per day (ppd) of chlorine can use up to 18 ppd of caustic material within the holding tank. Caustic material is expensive, and after the caustic material has been depleted, the purged waste material, containing caustic and the neutralized chlorine, must be properly disposed. Thus, need exists for a chlorine tank filling apparatus that can decrease the costs associated with processing and disposal of the material within the holding tank and avoids using a vacuum system to purge the filling manifold.

During the filling process when toxic or hazardous chemicals are being transferred into smaller cylinders, chemical loss occurs when the cylinders are connected to and disconnected from the filling manifold. The chemical remaining in the lines connecting the filling manifold to the cylinders leaks to the environment. This chemical loss is a health risk to both the operator and to the surrounding areas.

OBJECTS AND ADVANTAGES OF THE INVENTION

The present invention has several advantages over the prior art. First, the operating pressures of the present invention range between 0 and 150 pounds per square inch gauge (psig). Thus, the added capital and maintenance expenses associated with the prior art vacuum systems for gas purging have been minimized. Second, the amount of chlorine lost during processing while using this invention has been drastically reduced to below 1 ppd. The disposal costs for the purged chlorine and the size required for the caustic holding tank have been reduced because less caustic material is used. Therefore, the overall costs of operating the apparatus decrease because the holding tank is emptied fewer times per year. Finally, the design of the present valve assembly reduces chemical loss at the cylinder connections by scaling both the cylinder and the filing manifold from the environment when the cylinders are connected to and disconnected from the manifold.

With the aforementioned considerations in mind, it is therefore an object of this invention to provide a safe and effective apparatus and method for filling tanks and cylinders.

It is a further object of this invention to provide an apparatus that avoids using a vacuum system for purging chlorine or other hazardous or toxic chemicals ("process material") within the filling apparatus.

It is a further object of this invention to provide an apparatus that reduces the amount of purged process material per filled cylinder.

It is a further object of this invention to provide an apparatus that reduces the amount of caustic material needed for effective operation of the apparatus.

It is a further object of this invention to provide an apparatus that includes a valve assembly connected between the manifold and the cylinders that substantially minimizes process material loss to the environment.

It is a further object of this invention to provide an apparatus that can fill multiple tanks without the necessity of purging or evacuating the system between tank fillings.

It is a further object of this invention to provide a valve assembly connected between the manifold and the cylinders that can reduce the health risks associated with operating a tank filling system where toxic or hazardous materials are being transferred through the apparatus.

These and other advantages and objects of this invention shall become apparent from the ensuing description of the invention.

SUMMARY OF THE INVENTION

An apparatus and method for filling chlorine cylinders is disclosed. The apparatus comprises a source of purge gas, a source of chlorine, and a manifold. The manifold comprises a purge gas port in fluid communication with the source of purge gas; a chlorine port in fluid communication with the source of chlorine; at least one cylinder port so that a cylinder to be filled with chlorine can attach to the manifold; and, a manifold outlet. The source of purge gas comprises a compressor having a purge gas inlet; a dryer connected to operatively connected to the compressor; a filter connected to said dryer; and, a purge gas outlet connectable to the purge gas port. The purge gas is selected from air, nitrogen, argon, or a combination thereof and is chemically inert to chlorine. The apparatus further comprises a holding tank connected to the manifold, which has a caustic neutralization agent therein, whereby said neutralization agent neutralizes the chlorine when the chlorine flows into the holding tank.

A valve assembly may be used in connection with the tank filling apparatus, or in connection with other apparatus or methods. The valve assembly comprises an inlet valve connectable to an outlet valve having a first end adapted to engage a receptacle for holding process material and configured to have an inlet port; a second end adapted to engage said second end of an outlet valve and configured to have an outlet port; a bore extending between the inlet and outlet ports; and, a first plug movably positioned in the bore, having an open and a closed position, and sealing the inlet port from the outlet port when in the closed position. The valve assembly further comprises an outlet valve having a first end adapted to en gage a source of process material and configured to have an inlet port; a second end adapted to engage the inlet valve and configured to have at n outlet port; a bore extending between the inlet and outlet ports; and, a second plug movably positioned in the bore, having an open and a closed position, and sealing the inlet port from the outlet port when in the closed position. The valve assembly also comprises a transfer tube having a first end configured to be insertable into the inlet valve bore and configured to have at least one port; a second end configured to be insertable into the outlet valve bore and configured to have at least one port; a bore extending through the transfer tube, allowing fluid communication bet we en the ports.

The valve assembly may further comprise inserts positionable within the bores of the inlet or outlet valves. The inserts have bores extending therethrough to allow fluid communication between the ends thereof which are configured with one or more ports. In such embodiments, the ends of the transfer tube are configured to be insertable into the b ores of the inserts.

The method for filling chlorine cylinders using the above described apparatus comprises at least the steps of: (a) pressurizing the manifold with purge gas; (b) depressurizing the manifold; (c) connecting a chlorine cylinder to the manifold; (d) displacing the purge gas within the manifold with chlorine; and (e) filling the chlorine cylinder with chlorine.

BRIEF DESCRIPTION OF THE DRAWINGS

FIG. 2*b* illustrates the transfer tube used to transport process material between the valve bodies of the valve assembly that operatively connects the manifold to the cylinders.

FIG. 2*c* illustrates a fitting used to transfer process material from a cylinder having a valve assembly inlet valve attached to the intake valve normally attached to most cylinders.

DETAILED DESCRIPTION OF THE PREFERRED EMBODIMENTS OF THE INVENTION

Illustrations of preferred construction, design, and methods of operation of the invention are set forth below with specific references to the Figure. However, it is not the intention of the inventor that the scope of his invention be limited to these preferred embodiments.

Figure 1:
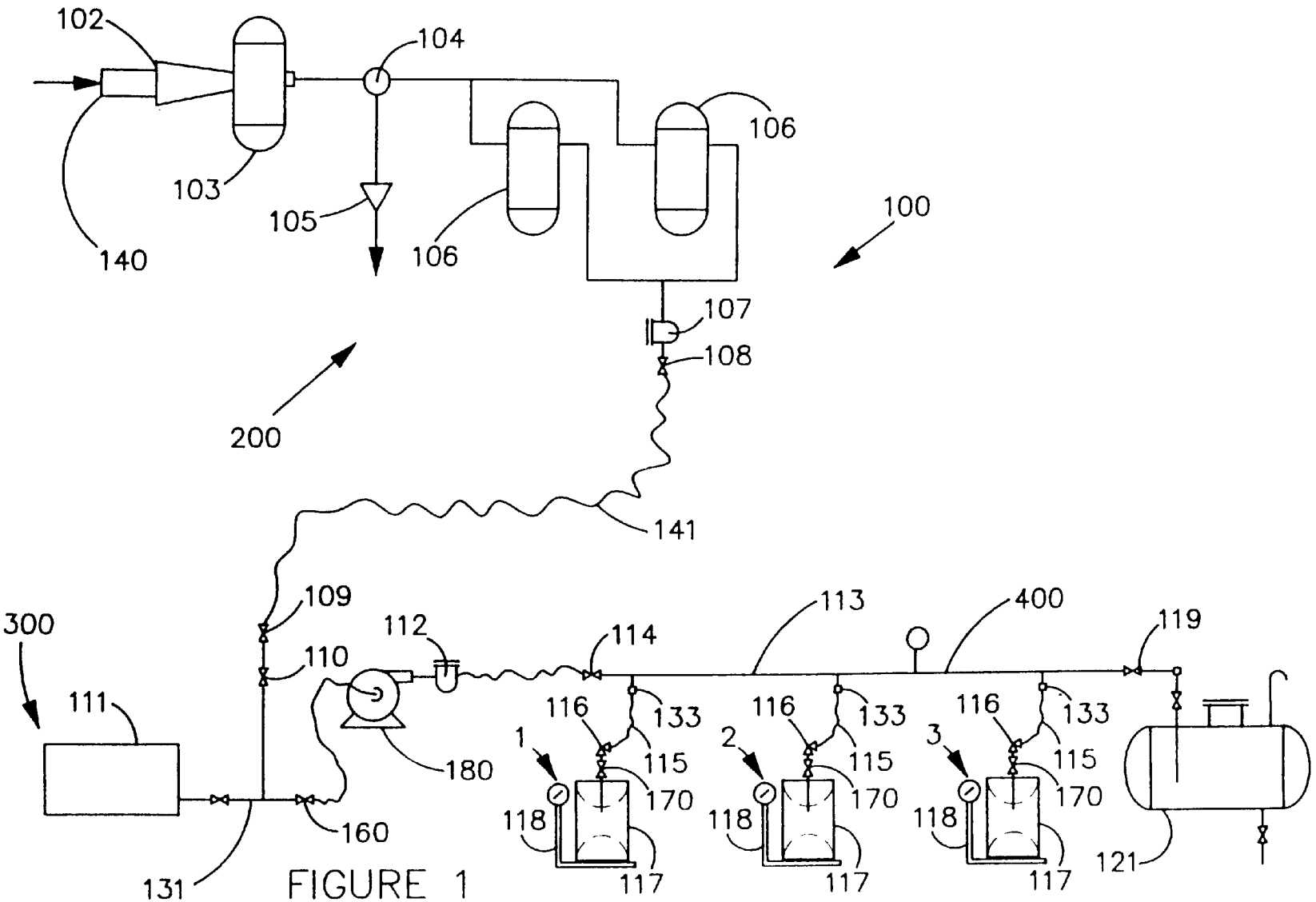
FIG. 1 illustrates an embodiment of the chlorine tank filling apparatus.

As shown in FIG. 1, chlorine tank filling apparatus 100 generally comprises a manifold 400 having a substantially particle-free, dry purge gas source 200 connectable thereto and having a substantially particle-free process material source 300 connectable thereto. "Process material" and "chlorine" are used interchangeably throughout. It is understood that this invention has application beyond the filling of chlorine cylinders and may be used to fill cylinders with other materials. Thus, process material is defined as the material being transported from tank 111 to cylinders 117. Purge gas flows from source 200 into manifold 400 through valve 109, valve 110, connection tee 131, valve 160, pump 180, filter 112, valve 114 and into holding tank 121 through manifold 400 and valve 119. Process material flows from source 300, preferably a tank 111, through connection tee 131, valve 160, pump 180, filter 112, valve 114 and into manifold 400. Process material then flows into one or more cylinders 117 or out manifold 400 through valve 119 into holding tank 121 where the material is neutralized and/or stored until disposal. Holding tank 121 has a dispersement device therein that disperses delivery of the process material flowing into tank 121 throughout tank 121. The compressed purge gas may be used to power pump 180.

Purge gas source 200 generally comprises a compressor 102, one or more dryers 106 operatively connected to compressor 102, and a filter 107. Purge gas enters compressor 102 through inlet 140 and is compressed to a desired pressure before being stored in tank 103. Compressor 102 is preferably designed with a discharge pressure of between 95 and 135 psig and may include an air-cooled after cooler. Purge gas flows from tank 103 into a gas/water separator 104 where any liquid water within the purge gas exits apparatus 100 through a drain 105. Separator 104 is preferably an air-water separator available from Wilkerson Co. of Englewood, Colo. having a capacity of 50 cubic feet per minute (cfm) at 100 psig. Drain 105 is an automatic drain, also available from Wilkerson. The purge gas may comprise air, nitrogen, argon, or other inert gas, or a combination thereof and is chemically inert to the process material.

From separator 104, purge gas enters one or more dryers 106 that remove substantially all water contained within the purge gas. After the water is removed, the purge gas flows through filter 107 to remove substantially all solid particles within the purge gas, resulting in a substantially particle-free, dry purge gas. Dryers 106 are preferably dessicant dryers having a −45° F. dew point, available from Wilkerson. Filter 107 is preferably a dessicant dryer after-filter with an automatic drain having about a 50 cubic feet per minute (cfm) capacity and uses a 1-micron filter replacement element, available from Ingersoll-Rand of New Jersey. A smaller or larger filter element may be required as the apparatus is scaled upward or downward.

After flowing through filter 107, the purge gas flows through a valve 108, preferably a gate valve, and through flex line 141 (which is connectable between valve 108 and valve 109), through valve 109, check valve 110 and into connection tee 131. Check valve 110 is positioned between valve 109 and connection tee 131 to prevent process material from flowing into the purge gas source 200. Valves 109, 114 are the type and kind normally used for chlorine processing and are preferably ball valves having carbon-steel bodies and MONEL stems. Check valve 110 is preferably a chlorine lift check valve available from Bonny Forge of Mount Union, Pa. or Velan Valve Corp. of Williston, Vt.

Chlorine source 300 comprises a chlorine tank 111 having a valve attached thereto and which allows connection tee 131 to sealingly connect to tank 111 using a standard yoke and yoke adapter. A chlorine filter 112 is shown positioned between valve 160 and valve 114, but filter 112 may be positioned between connection tee 131 and valve 160 so that the chlorine is filtered before flowing through valve 114. Connection tee 131 has inlets fluidly connecting to process material source 300 and to purge gas source 200 and an outlet fluidly connecting to manifold 400. A pump 180 may be positioned between valve 160 and filter 112 to assist in the filling process as described below, but preferably pump 180 is positioned between filter 112 and valve 114. Filter 112 is preferably a SWAGELOK in-line chlorine filter constructed from a suitable material such as MONEL 400 and having a filter element of between about 1 and 50 microns, available from Swagelock Co. or Crawford Fitting Co., both of Solon, Ohio.

Manifold 400 generally comprises a length of pipe 113 configured to have an inlet through valve 114, one or more cylinder ports 133, and an outlet through valve 119. Valves 114, 119 regulate flow entering and exiting manifold 400. Cylinder ports 133 allow fluid communication between manifold 400 and cylinders 117 through connection lines 115 and valve assembly 116 during the filling process. During operation, cylinders 117 are positioned on scales 118 to help determine when cylinders 117 are full.

Figure 2A:
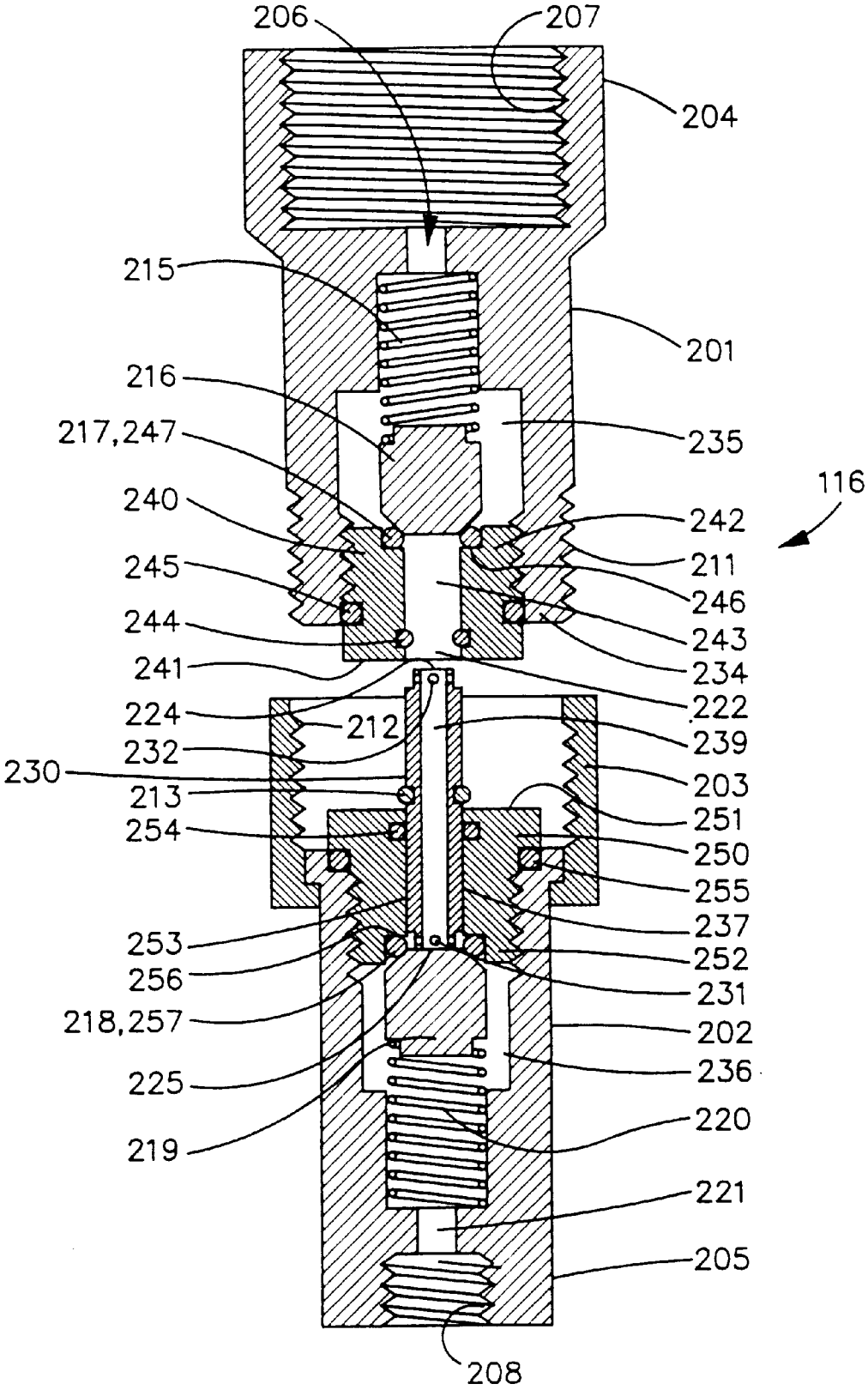
FIG. 2*a* illustrates a cross-sectional view of a preferred embodiment of a valve used with the invention to connect the manifold to a cylinder.

As shown in FIG. 2*a*, valve assembly 116 comprises an inlet valve 201 connectable to an outlet valve 202. Valves 201, 202 may be connected directly to each other using threaded or other connections, such as a coupler 203. Coupler 203 is rotatably mounted to outlet valve 202 using a shoulder and snap ring assembly, or any other suitable assembly for connecting coupler 203 to outlet valve 202. Each valve 201, 202 is constructed similar to a spring-loaded ball or plug check valve having a plug or ball positioned within the bores 235, 236 of respective valves 201, 202.

Inlet valve 201 is configured with inlet port 222 and an outlet port 206 with bore 235 extending therebetween. First end 204 of inlet valve 201 is configured with threads 207 that mate with opposing threads on cylinder 117 or other receptacle for holding a process material. Positioned on the outer surface of inlet valve 201 at second end 234 are threads 211 that mate wit corresponding threads 212 on coupler 203 or other connection member on outlet valve 202. Positioned within bore 235 is first spring 215 operatively positioned or mounted therein so that first plug 216 seals against seat 217 when at rest, thereby sealing inlet port 222 from outlet port 206. Seats 217 may be constructed from suitable o-rings.

Outlet valve 202 is configured with an outlet port 237 and inlet port 221 with bore 236 extending therebetween. First end 205 may be configured with threads 208 which mate with opposing threads on connection line 115. Positioned within bore 236 is second spring 220 operatively positioned or mounted therein so that second plug 219 rests against seat 218 when in a closed position, thereby sealing inlet port 221 from outlet port 237.

Transfer tube 230 is a cylindrical member having ends that are configured to slidingly insert into the bores 235, 236 of valves 201, 202 through ports 222, 237 (or bores 241, 21 of inserts 240, 250). Transfer tube 230 is configured with a bore 239 therein extending axially between ends 224, 225. Transfer tube 230 is configured with one or more ports 231, 232 that allow fluid to flow around the respective plugs 216, 219 when ends 224, 225 engage plugs 216, 219. Ports 231,232 may be configured to be apertures, such as circular holes. An o-ring seal 213 may be positioned around the outer walls of transfer tube 230 so that when tube 230 engages bore 235 (or bore 243), seal 213 seals bore 235 (or bore 243).

Although not required, as shown in FIG. 2*a*, valve assembly 116 may further comprise first and second inserts 240, 250, positioned within bores 235, 236 so that transfer tube 230 may slidingly engage first and second inserts 240, 250. Each insert 240, 250 has a face end 241, 251 and a seat end 242, 252 with a bore 243, 253 extending therebetween. An o-ring seal 244, 254 may be positioned along the walls of bores 243, 253 to provide additional seal protection when in operation. Additional o-ring seals 245, 255 may be positioned between the respective inserts 240, 250 and valve 201, 202 for additional seal protection. Inserts 240, 250 have shoulders 246, 256 along seat end 242, 252 that allow O-rings 247, 257 to form seats 217, 218 upon which plugs 216, 219 rest in a closed position. In embodiments with inserts 240, 250, ports 222, 237 are defined by the inner walls of inserts 240, 250.

If no inserts 240, 250 are used, the body of valves 201, 202 fills the area otherwise occupied by inserts 240, 250. Seals 244, 254 are then positioned in the same approximate area along bores 235, 236 that seals 244, 254 are positioned within bores 243, 253 so that transfer tube 230 sealingly and slidably engages the walls of bores 235, 236.

Inlet and outlet valves 201, 202 are preferably constructed from brass or other suitable material that is corrosion resistant to the process material flowing through the valve. The seals used in valve assembly 116 are preferably o-rings constructed from VITON, a synthetic rubber material available from E.I. DuPont De Nemours & Co., Inc. of Wilmington, Del. Inserts 240, 250 are preferably constructed from KYNAR, available from Pennwalt Corp. of Philadelphia, Pa. Springs 215, 220 are constructed from a corrosion resistant material, preferably HASTELLOY.

During the chlorine cylinder filling process, valve assembly 116 operates as follows. Inlet valve 201 is securely connected to cylinder 117. Next, outlet valve 202 is securely connected to connection line 115. Next, outlet valve 202 is positioned over inlet valve second end 234 so that coupler threads 212 engage corresponding threads 211 on inlet valve 201. Coupler 203 is rotated so that inlet and outlet valves 201, 202 are forced toward each other. As this occurs, transfer tube 230 inserts into inlet port 222, passing seals 244 and forming a sealed connection between the outer walls of transfer tube 230 and either the walls of bore 235 or the walls of insert 240. As coupler 203 is further rotated, transfer tube end 224 engages and abuts first plug 216, and o-ring 213 abuts face 241, preventing transfer tube 230 from moving any further into inlet valve 201 and forcing end 225 to abut and exert pressure on plug 219. As coupler 203 continues to rotate, transfer tube ends 224, 225 exert additional pressure against plugs 216, 219 until plugs 216, 219 disengage seats 217, 218.

First spring 215 has a spring constant less than the spring constant for second spring 220. Thus, first plug 216 disengages seat 217 before the additional force required to displace second plug 219 from seat 218 is exerted. When enough force has been applied to springs 215, 220 to displace both plugs 216, 219, chlorine flows from connection line 115, through port 221 into bore 236 (or into bore 254 and then into bore 236) through transfer tube bore 239, into bore 235 (or into bore 244 and then into bore 235) through port 206 and into cylinder 117.

When cylinder 117 is filled, coupler 203 is rotated in an opposite direction until coupler 203 disengages inlet valve 201. As this occurs, the action of transfer tube 230 is reversed: second plug 219 seals against seat 218, sealing connection line 115 from the environment, and first plug 216 seals against seat 217, sealing cylinder 117 from the environment. As second plug 219 seals against seat 218, the vapor pressure within transfer tube bore 239 equalizes to the vapor pressure within cylinder 117 causing any liquid within bore 239 to flash before plug 216 seats against seat 217. The phase change decreases the amount of process material within bore 239 because gasses occupy a greater volume due to a decreased density. Thus, less process material is present within bore 239. Process material (chlorine) loss is limited to the amount of material contained within transfer tube bore 239. In a preferred embodiment, transfer tube 230 is about ⅞ inches long and bore 239 has an inside diameter of about 3⁄16 inches—about 0.024 $In^3$. Thus, each time a cylinder 117 is filled, minimal losses of process material occur.

Inlet valve 201 may be connected to the standard intake valves 170 on cylinders 117 each time the cylinders are filled, but preferably cylinders 117 are retrofitted so that inlet valve 201 is fixedly attached to intake valve 170. Where the cylinder 117 has an inlet valve 201 connected to intake valve 170 or retrofitted as a part thereof, a fitting 405 may be attached thereto to allow transport from the cylinder 117 as shown in FIG. 2*c*. Fitting 405 is similar to outlet valve 202 but comprises a coupler 401 engageable with opposing threads 211 on inlet valve 201 and having an insert 402 positioned therein with a wand 403 that unseats plug 215 allowing flow through a bore 404 in insert 402 and into the device, apparatus, or process to which fitting 405 is attached. By controlling the number of turns coupler 401 makes when engaging inlet valve 201, a user can control the amount of process material flowing through fitting 405. More turns of coupler 401 will open plug 216 further, increasing flow through valve 201 and fitting 405, and vice versa.

During construction and start-up of apparatus 100, the chlorine piping must be kept moisture-free. If installation is delayed, it is preferred that covers be installed over the pipe ends. Once the chlorine piping is installed, dry purge gas should be passed through the piping for at least 14 hours prior to start-up. Apparatus 100 should be pressurized to between about 120 and about 130 psig using the purge gas to check for leaks before start-up begins.

After the leak check is completed, apparatus 100 is ready for start-up. First, the purge gas is removed from manifold 400. Manifold 400 is depressurized to about 1.5 psig by opening valve 119 and allowing purge gas to flow into holding tank 121. Valve 119 is then closed. Next, valve 160 is fully opened and valve 114 is slowly opened to about 25%, until approximately 0.5 gallons per minute (gpm) of chlorine flows through valve 114. The chlorine displaces the purge gas into holding tank 121. Displacement of the purge gas from manifold 400 into holding tank 121 occurs for about 30 seconds until substantially all purge gas is removed from manifold 400 and from connection lines 115. Valve 160 is then closed, and the chlorine within manifold 400 is allowed to flow into holding tank 121 until the pressure within manifold 400 is about 1.5 psig. Valves 114, 119 are then closed and the apparatus is ready to fill chlorine cylinders 117 during the filling phase.

During the filling phase, flex line 141 may be disconnected from valve 109. Valves 109, 114, and 119 are all checked to ensure they are closed.

One or more cylinders 117 are pre-cooled to below about 32° F. to lower the vapor pressure within cylinders 117. Cooled cylinders 117 are connected to each filling position 1, 2, 3 along manifold 400 at cylinder ports 133 using connection lines 115 and valve assembly 116. The intake valves 170 on cylinders 117 are checked to ensure they are closed. Next, valves 160, 114 are opened, and the intake valves 170 on cylinders 117 at filling positions 1 and 2 are opened. Because the vapor pressure in the cooled cylinders 117 is lower than the vapor pressure in tank 111, liquid chlorine flows from tank 111, through manifold 400, and into cylinders 117. Scales 118 monitor the amount the chlorine within each cylinder 117. Pump 180 may be employed to assist in the filling process.

When cylinders 117 at filling positions 1, 2 are full (about 1–2 minutes for a 20 lb. cylinder), the intake valves 170 on the cylinders 117 are closed. Valve 114 is then closed. The intake valve 170 on cylinder 117 at position 3 is then opened and the chlorine remaining in manifold 400 flows into cylinder 117 at position 3 until the pressure within manifold 400 has dropped below about 50 psig. The intake valve 170 on the cylinder 117 at position 3 is closed. The filled cylinders 117 at positions 1 and 2 are disconnected and replaced with two empty cooled cylinders 117. The intake valve 170 on cylinder 117 at position 3 and the intake valve 170 on the cylinder 117 at position 1 (or 2, but not both) are opened. Valve 114 is opened, filling the cylinders 117 at positions 3 and 1. When the cylinders 117 at positions 3 and 1 are filled, the inlet valves are closed. The inlet valve on cylinder 117 at position 2 is then opened until the pressure within manifold 400 has dropped below about 50 psig. The process is then repeated where two tanks are filled and a third is used to bleed the chlorine from manifold 400 as described. By depressurizing manifold 400, the amount of chlorine remaining in transfer tube 230 when inlet valve 201 and outlet valve 202 are disconnected is decreased.

When a desired number cylinders 117 have been filled or when the chlorine within tank 111 has been exhausted, the intake valves 170 on the cylinders 117 and valve 114 are closed, and cylinders 117 remain connected to manifold 400 while manifold 400 is evacuated or purged to allow refilling of tank 111 or for maintenance. The intake valve 170 on the unfilled cylinder 117 is opened to bleed the chlorine from within manifold 400 as previously described, and the intake valve 117 on the previously unfilled cylinder 117 is then closed (the unfilled cylinder may not be completely or substantially fall). Valve 160 is closed. Valve 119 is opened to allow chlorine to flow into holding tank 121. Valve 119 is then closed, and valve 114 is opened to allow chlorine to flow into holding tank 121 as valve 119 is reopened to release any residual chlorine to holding tank 121.

Flex line 141 is connected to valve 109. Compressor 102 is turned on so that the purge gas is pressurized to at least about 90 psig, preferably between about 120 and 130 psig. The purge gas is checked for necessary dryness. When a desired purge gas dryness has been achieved, valve 109 is opened to sweep the chlorine between valve 110 and valve 119 into holding tank 121. Valve 119 is closed until the pressure in the manifold 400 is reaches at least 90 psig, more preferably between about 120 and about 130 psig. Valve 119 is slowly opened to allow the purge gas and any remaining chlorine to flow into holding tank 121, thereby depressurizing manifold 400. The opening and closing of valve 119 is repeated (usually about 3–4 times) the chlorine concentration within manifold 400 is non-detectable, preferably less than 1 ppm, more preferably less than 0.3 ppm. Valve 109 is then closed, and valve 119 is opened to depressurize manifold 400 to less than about 1.5 psig. The cylinders 117 at each fill position 1, 2, 3 are then disconnected. Valve 119 is closed and compressor 102 is turned off.

While this invention has been described in terms of a preferred embodiment for use with chlorine, other liquids or gases may be processed in accordance with the apparatus and method described herein, and this invention is not limited to chlorine processing. Additionally, although threaded connections have been described herein for the cylinder valve components, other types of connections well-known in the art could also be used.

Although the preferred embodiment has been described, it will be appreciated by those skilled in the art to which the present invention pertains that modifications, changes, and improvements may be made without departing from the spirit of the invention defined by the claims.

What is claimed is:

1. A method for filling one or more cylinders with a process material using a filling apparatus comprising a source of purge gas, a source of process materials, and a manifold in fluid communication with said source of purge gas with said source of process material, and with a holding tank, said manifold operatively connectable to said cylinder and said manifold are in fluid communication, said method comprising the steps of:

(a) pressurizing said manifold with said purge gas;

(b) depressurizing said manifold;

(c) connecting at least two cylinders to said manifold;

(d) displacing said purge gas within said process material; and (e) filling at least one of said at least two cylinders, leaving at least one cylinder unfilled;

(f) sealing said manifold from said source of process material (g) depressurizing said manifold by flowing said process material into at least one of the unfilled cylinders connected to said manifold; and (h) disconnecting tile filled cylinders from said manifold.

2. The method according to claim 1 further comprising the steps of:

(j) connecting cylinders to said manifold in place of the disconnected cylinders;

(k) filling at least one of said cylinders connected to said manifold;

(l) sealing said manifold from said source of process material; and (m) depressurizing said manifold by flowing said process material into at least one of the non-filled cylinders connected to said manifold.

3. The method according to claim 2 further comprising the step of repeating steps (j)–(m) until a desired number of said cylinders are filled.

4. The method according to claim 3 further comprising the step of disconnecting the filled cylinders from said manifold.

5. The method according to claim 4 further comprising the step of repeating steps (j)–(l) until a desired number of cylinders are filled.

6. The method according to claim 3 further comprising the step of evacuating said manifold.

7. The method according to claim 6 further comprising the step of evacuating said manifold comprises the steps of:

(i) pressurizing said manifold with said purge gas and any remaining process material;

(ii) allowing said purge gas and any remaining process material within said manifold to flow into said holding tank;

(iii) repeating steps (i) and (ii) until the concentration of process materials within the manifold is less than 1 ppm.

8. The method according to claim 7 further comprising the step of disconnecting the filled cylinders from said manifold.

9. The method according to claim 7 further comprising the step of repeating steps (i) and (ii) until the concentration of process material with in said manifold is less than 0.3 ppm.

10. The method according to claim 9 further comprising the step of filtering substantially all particles from said process material entering said manifold.

11. The method according to claim 10 further comprising the step of filtering substantially all particles from said purge gas entering said purge gas port.

12. The method according to claim 11 wherein said manifold is pressurized to at least 90 psig.

13. The method according to claim 12 wherein said manifold is depressurized to about 0.5 psig.

14. The method according to claim 13 wherein said purge gas is selected from the group consisting of air, nitrogen, argon, inert gas and a combination thereof.

15. The method according to claim 13 wherein said purge gas is inert to said process material.

16. The method according to claim 11 wherein said manifold is pressurized to between about 120 and about 130 psig.

17. The method according to claim 2 wherein the step of filling at least one of said cylinders connected to said manifold comprises filling the cylinder used to depressurize said manifold.

18. The method according to claim 1 wherein said process material is chlorine.

19. A cylinder filling apparatus comprising:

(a) a source of purge gas;

(i) a compressor having a purge gas inlet;

(ii) a dryer fluidly connected to said compressor; and (iii) a filter fluidly connected to said dryer;

(b) a source of process material; and (c) a manifold comprising an inlet and an outlet, said inlet operatively connectable to said source of purge gas and said source of process material, said outlet operatively connectable to a holding tank; and, at least one cylinder port whereby a cylinder can attach to said manifold for filling.

20. The apparatus according to claim 19 wherein said purge gas is selected from the group consisting of air, nitrogen, argon, inert gas and a combination thereof.

21. The apparatus according to claim 20 wherein said purge gas is inert to said process material.

22. The apparatus according to claim 21 further comprising a connection tee, said connection tee having a first inlet connectable to said source of purge gas, a second inlet connectable to said source of process material, and an outlet fluidly connectable to said manifold.

23. The apparatus according to claim 22 wherein said manifold further comprises an inlet and an outlet valve.

24. The apparatus according to claim 23 further comprising a valve positioned between said connection tee and said inlet valve.

25. The apparatus according to claim 22 further comprising a pump operatively positioned between said source of process material and said cylinder port.

26. The apparatus according to claim 25 further comprising a filter operatively positioned between said connection tee and said inlet valve.

27. The apparatus according to claim 21 further comprising a holding tank connected to said manifold outlet, said holding tank having a neutralization agent therein, whereby said neutralization agent neutralizes said process material.

28. A method for filling at least one container with a process material using a manifold in fluid communication with a source of process material comprising:

connecting at least two containers to said manifold;

supplying said process material to said manifold;

filling at least one of said at least two containers, leaving at least one of said at least two containers unfilled, sealing said manifold from said source of process material;

allowing process material in said manifold to flow into at least one of the unfilled containers connected to said manifold; and disconnecting the filled containers from said manifold.

29. A method as claimed in claim 28 wherein said manifold is also in fluid communication with a source of purge gas, further comprising:

providing said purge gas to said manifold, displacing said purge gas within said manifold with said process material.

30. A method as claimed in claim 29 wherein said manifold is pressurized with said purge gas; further includ ing depressurizing said manifold pressurized with said purge gas.

31. A filling apparatus comprising (a) a source of purge gas comprising, a dryer connected to receive said purge gas; and a filter connected to said dryer:

(b) a source of process material; and (c) a manifold comprising an inlet and an outlet, said inlet connected to said source of purge gas and said source of process material, said outlet connected to a holding tank; and at least one container port whereby a container can attach to said manifold for filling.

* * * * *